US008100274B2

(12) United States Patent
Trowsdale et al.

(10) Patent No.: US 8,100,274 B2
(45) Date of Patent: Jan. 24, 2012

(54) CLOTHES AIRER

(75) Inventors: Dan Trowsdale, Leeds (GB); Tom Hirst, Holmfirth (GB)

(73) Assignee: Vale Mill (Rochdale) Limited, Rochdale, Lancashire (GB)

( * ) Notice: Subject to any disclaimer, the term of this patent is extended or adjusted under 35 U.S.C. 154(b) by 211 days.

(21) Appl. No.: 12/352,298

(22) Filed: Jan. 12, 2009

(65) Prior Publication Data

US 2009/0178987 A1 Jul. 16, 2009

(30) Foreign Application Priority Data

Jan. 12, 2008 (GB) ..... 0800534.0

(51) Int. Cl.
*A47B 43/00* (2006.01)

(52) U.S. Cl. ..... 211/195; 211/202

(58) Field of Classification Search ..... 211/198, 211/195, 201, 182, 85.24, 197, 181.1, 13.1, 211/164, 166, 189, 200; 248/164, 431, 440, 248/434, 175, 166; 403/344, 49, 83, 87; 297/16.2, 20, 16.1
See application file for complete search history.

(56) References Cited

U.S. PATENT DOCUMENTS

| | | | | | |
|---|---|---|---|---|---|
| 39,706 | A | * | 8/1863 | Saunders | 211/198 |
| 149,569 | A | * | 4/1874 | Brown | 211/201 |
| 411,967 | A | * | 10/1889 | Riesick | 403/344 |
| 0,674,271 | A | | 5/1901 | Knapp | |
| 674,271 | A | * | 5/1901 | Knapp | 211/202 |
| 716,393 | A | * | 12/1902 | Downing | 211/198 |
| 745,641 | A | * | 12/1903 | Messerly | 211/195 |
| 2,087,359 | A | | 7/1937 | Sadenwater | |
| 2,356,930 | A | * | 8/1944 | Horstkotte | 211/170 |
| 2,388,637 | A | * | 11/1945 | John | 211/170 |
| 2,479,887 | A | | 8/1949 | Wolcott | |
| 2,897,013 | A | * | 7/1959 | Delp | 52/645 |
| 4,068,965 | A | * | 1/1978 | Lichti | 403/313 |
| 4,373,235 | A | * | 2/1983 | Korgaonkar | 24/285 |
| 4,807,766 | A | * | 2/1989 | Compagnucci | 211/198 |
| 6,082,813 | A | * | 7/2000 | Chen | 297/16.2 |
| 6,155,743 | A | * | 12/2000 | Chen | 403/374.1 |
| 2003/0024203 | A1 | | 2/2003 | Kuo | |
| 2004/0104190 | A1 | * | 6/2004 | Trowsdale | 211/202 |
| 2006/0054753 | A1 | * | 3/2006 | Lee | 248/166 |
| 2006/0138066 | A1 | * | 6/2006 | Hung et al. | 211/189 |
| 2009/0134673 | A1 | * | 5/2009 | Deng | 297/16.2 |

FOREIGN PATENT DOCUMENTS

| | | |
|---|---|---|
| FR | 1364136 A1 | 6/1964 |
| FR | 2634795 B3 | 2/1990 |
| GB | 967693 | 8/1964 |

* cited by examiner

*Primary Examiner* — Darnell Jayne
*Assistant Examiner* — Patrick Hawn
(74) *Attorney, Agent, or Firm* — Barlow, Josephs & Holmes, Ltd.

(57) ABSTRACT

A clothes airer with a number of pairs of pivotally connected pairs of frames 1. The pairs of frames are pivotally connected to each other at their free ends and to legs 5. One frame of each pair is pivotally connected to one or more legs 5 and the other is pivotally connected to one or more fittings 7 slidably mounted on respective legs 5.

17 Claims, 5 Drawing Sheets

CLOTHES AIRER

BACKGROUND AND SUMMARY OF THE INVENTION

The present invention relates to a clothes airer.

A variety of folding frame clothes airers are known. One existing arrangement comprises three pairs of pivotally connected rectangular frames. The two frames forming each pair are pivotally connected together at points approximately midway along their respective opposite sides. Rods or wires extend between these opposite sides to provide support for clothes and other articles to be placed on the airer. The frames of each pair can be moved between a closed position where the two frames lie in substantially the same plane and an open position where they extend at, or towards, right angles to each other.

The three pairs of connected frames are connected one to the other in series by means of pivots between adjacent free ends of each frame of each pair of adjacent pairs of frames. This way, the plurality of frames move together between the open and closed positions, in a concertina fashion.

To support the connected pairs of frames over a surface two pairs of telescopic legs are provided. The legs extend between the corners of the pivotally connected pairs of frames with one telescopic element being connected to one connected set of frames of each pair and the other telescopic element being connected to the other set of frames of each pair to allow the pivotally connected frames to be moved between open and closed positions. As the frames are moved to the closed positions one telescopic member slides into the other, the two pairs of lugs move together and the airer collapses into a folded flat state. As the pivotally connected frames are moved to the open position one telescopic member is withdrawn from the other and the two pairs of telescopic legs separate and provide a stable support for the airer.

Provision of telescopic legs adds complexity to the structure and results in the overall height of the structure changing as the pairs of connected frames move between the open and closed positions.

Embodiments of the present invention address these issues.

According to the present invention there is provided a clothes airer comprising at least one pair of pivotally connected frames and at least one support member wherein one frame of the pair of connected frames is pivotally connected to the support member and the other frame of the pair of frames is pivotally connected to a fitting which is slidably mounted to the support member, enabling it to slide along at least part of the length of the support member.

Provision of a slidably mounted fitting enables an airer to be constructed which may be folded without the need to provide telescopic legs.

The fitting may capture the support member. The fitting may define a through aperture, through which the support member extends. The fitting may be operable between an open state in which it may be mounted laterally on the support member and a closed state in which, when mounted on the support member, it may move longitudinally relative to the support member but not be displaced laterally from the support member. This enables the fitting to be fitted to a support member, in particular an elongate support member, without having to pass the fitting over an end of the member. This is useful where there are multiple support members connected by cross members as the fittings may be fitted to the support members after the cross-members have been attached. The fitting may comprise two engageable components. There may be four or more support members. The support members may be provided in pairs. Each pair of support members may be provided by a U-shaped frame. The or each support member preferably forms a leg for supporting the pair of pivotally connected frames above a surface. Multiple pairs of pivotally connected frames may be provided. Each pivotally connected frame may be generally rectangular and include a plurality of cross members for supporting articles on the airer. Each frame of each pair of pivotally connected frames is preferably connected to the support member (directly or via a fitting as appropriate) at free ends of the frame. In one arrangement each pivotally connected frame is connected to two support members.

BRIEF DESCRIPTION OF THE DRAWING FIGURES

In order that the invention may be more clearly understood embodiments thereof will now be described by way of example with reference to the accompanying drawings of which:

DESCRIPTION OF THE PREFERRED EMBODIMENTS

Figure 1:
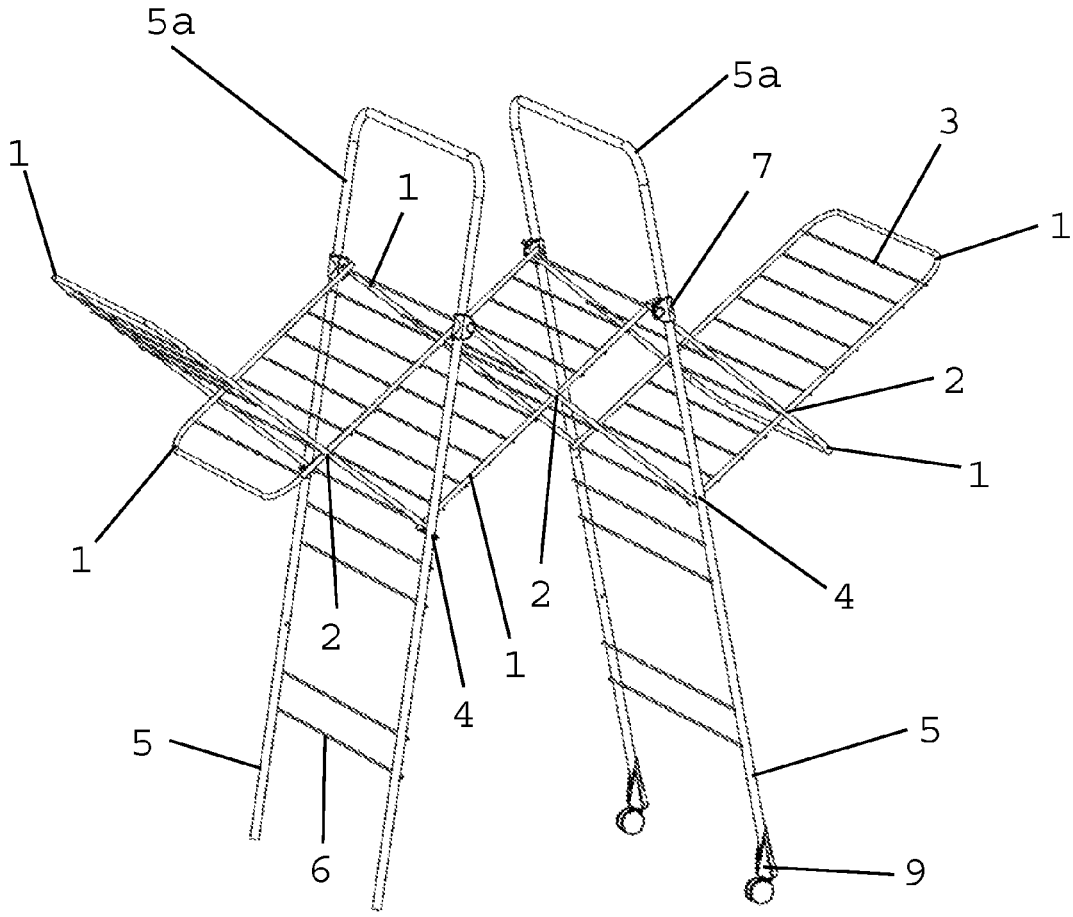
FIG. 1 is a perspective view of an airer according to the invention in an unfolded state.
Figure 2:
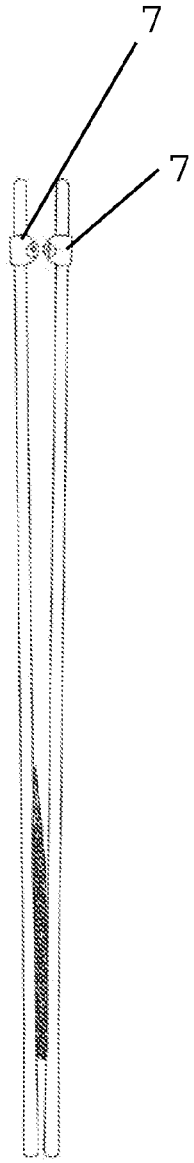
FIG. 2 is a side view of the airer of FIG. 1 in a folded state.
Figure 3:
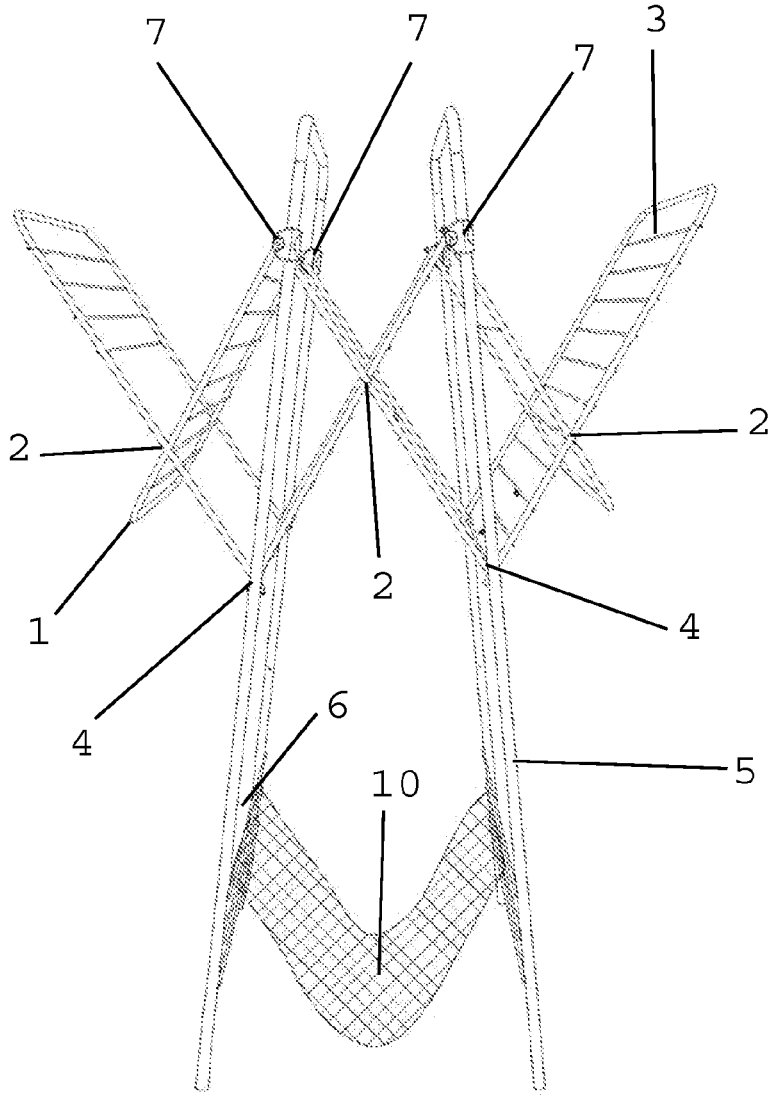
FIG. 3 is a side view of the airer of FIG. 1 in a partially folded state.

Referring to the drawings, FIGS. 1 to 4 show various views of a clothes airer according to the invention. The general form of the airer is known. The airer comprises three pivotally mounted pairs of generally rectangular frames 1. The two frames of each pair are pivotally connected together at points 2 spaced along their longer sides. Generally parallel rails or wires 3 extend between the longer sides of the frames 1 to provide support for items to be aired.

The outer parts of the illustrated frames are formed from mild steel tubing but any other suitable material could be used.

Each of the three pairs of pivotally connected frames 1 is pivotally connected to an adjacent pair of frames such that the central pair of frames is connected to two outer pairs of frames. The pairs of frames are pivotally connected together by pivotal connections 4 between the free ends of respective frames of each pair.

The airer further comprises four legs 5 formed by two generally inverted U-shaped frames 5*a* each having two substantially parallel tubular sides which form the legs. Substantially parallel spaced apart wires 6 extend between the legs of each inverted U-shaped frame to provide further support for items on the airer.

The lower of the pivots 4 between the pairs of substantially rectangular frames are pivotally connected to respective legs 5. The upper pivotal connections 4 are pivotally connected to sliding fittings 7 which are mounted for sliding movement along the legs 5 as shown by arrows 8. The fittings 7 are arranged so that the pivot 4 is disposed to one side of the leg 5.

Wheels 9 are fitted to the lower ends of the legs 5 formed by one inverted U-shaped frame. The wheels are only shown in FIG. 1. A net 10 extends between wires 6 of the two pairs of legs 4.

Figure 4:
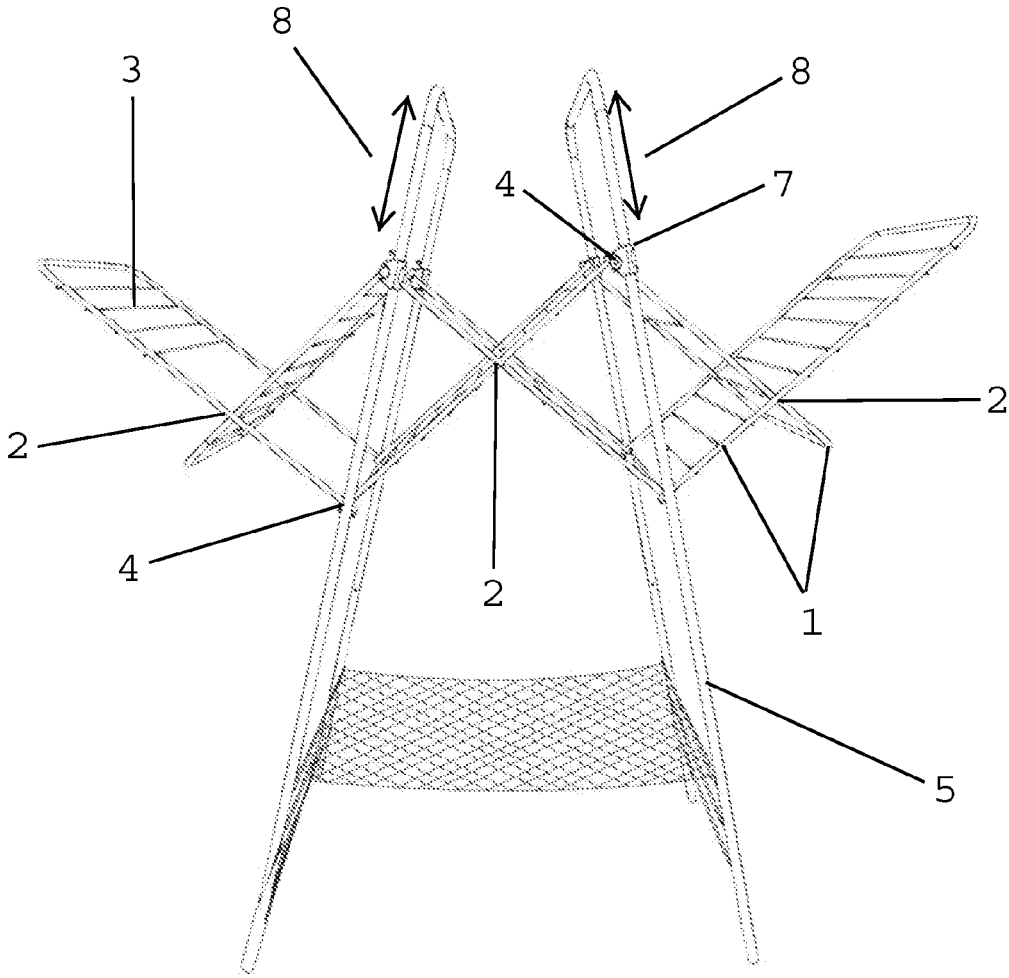
FIG. 4 is a side view of the airer of FIG. 1 in an open state.

The airer may be moved between an open and closed state. The open state is shown in FIGS. 1 and 4. In the open state the generally rectangular frames 1 of each connected pair lie generally at right angles to each other. The two inverted U-shaped frames 5*a* are separated and the two pivot points 4 on each leg 5 are at their closest separation. The net 10 is generally taut between the two inverted U-shaped frames 5*a*.

To move the airer into its closed position, in which it occupies less space, for example for storage, the two U-shaped frames 5*a* are moved towards each other. Conveniently, the frame equipped with wheels 8 is moved toward the other frame. As the inverted U-shaped frames approach the frames of each pivotally connected pairs of frames 1 pivot relative to each other and adopt a position in which they lie in substantially the same plane. To accommodate this movement the sliding fittings 7 slide upwards on the inverted U-shaped frames and the pivot points 4 on each frame adopt a position of maximum separation. The netting 10 becomes slack between the two inverted U-shaped frames 5*a*.

Provision of sliding fittings 7 is a convenient, cost effective and easy to assemble way to construct the airer. The overall length of the U-shaped frames remains constant throughout all positions between the open and closed positions.

Figure 5:
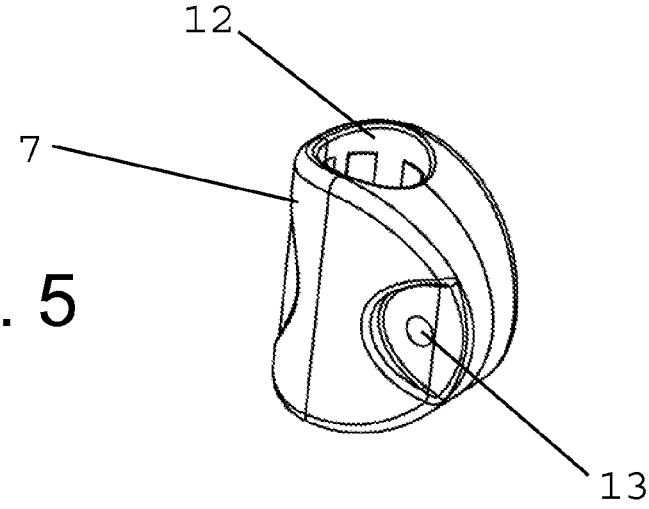
FIG. 5 is a perspective view of a sliding fitting of the airer of FIG. 1 in a closed state.
Figure 7:
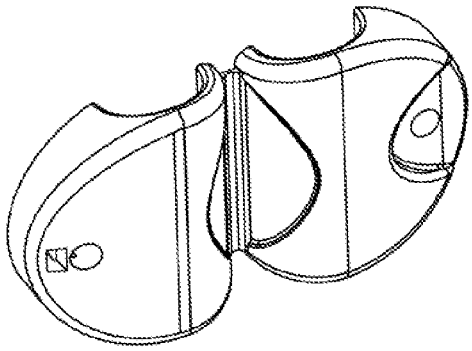
FIG. 7 is a perspective view of the outside of the fitting of FIG. 5 in an open state.
Figure 6:
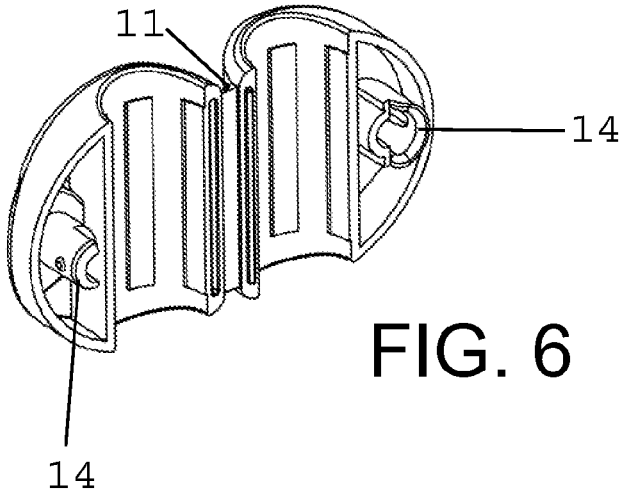
FIG. 6 is a perspective view of the inside of the fitting of FIG. 5 in an open state.

The sliding fittings 7 are shown in greater detail in FIGS. 5 to 7. Referring to those figures the fitting 7 comprises a moulded plastics material component formed in a single piece comprising two halves connected by a flexible (live) hinge 11. This enables the fitting to adopt open and closed positions shown in FIGS. 6 and 7, and 5 respectively. In the closed position the fitting defines a generally cylindrical passage 12. Radially to the side of that passage is a formation defining an aperture 13 the axis of which extends substantially at right angles to that of the cylindrical passage 12. The cylindrical passage 12 receives a leg 5 of the frame with a sliding fit. The aperture 13 receives a pin or fastener to form a pivot with the rectangular frames. The fastener or pin serves to hold the sliding fitting in its closed position although engageable fittings 14 are also provided on the two halves of the fitting which cooperate to secure the fitting in the closed position. As the fitting can be opened and closed this enables it to be mounted on a leg 5 of the frame without having to pass over the end of the leg. As such, the fitting can be fitted onto a leg after the cross-wires 6 have been connected between two legs of an inverted U-shaped frame 5*a*.

Figure 8:
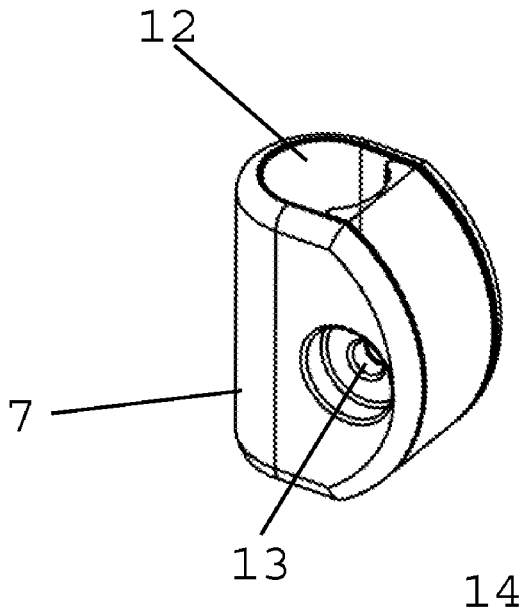
FIG. 8 is a perspective view of an alternative embodiment of a sliding fitting.
Figure 9:
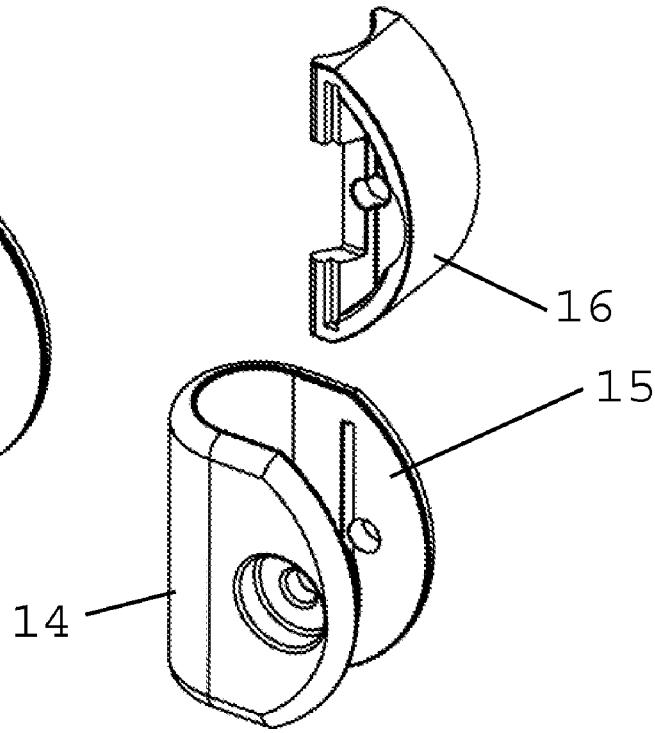
FIG. 9 is a perspective view of the fitting of FIG. 8 with its two components separated.

FIGS. 8 and 9 show an alternative embodiment of a sliding fitting 7. This embodiment comprises two separable moulded plastics material components. The first component 15 is of a generally U-shaped cross-section. The second component 16 engages with the first component 15 with a sliding fit. In its assembled state the fitting defines a cylindrical passage 12 and aperture 13 similar to the embodiment illustrated in FIG. 5. The two-part structure of the fitting also enables it to be laterally fitted to a leg of an airer without having to pass over a free end of the leg.

The above embodiments are described by way of example only. Many variations are possible without departing from the invention as defined by the appended claims.

The invention claimed is:

1. A clothes airer comprising at least one pair of pivotally connected frames and at least one support member wherein one of the pair of connected frames is pivotally connected to at least one support member and the other frame of the pair of frames is pivotally connected to a fitting which is slidably mounted to at least one support member, enabling it to slide along at least part of the length of at least one support member, wherein the fitting defines a part that extends around at least one support member so that it captures at least one support member with a sliding fit, the fitting being operable between an open state in which it may be mounted laterally on at least one support member and a closed state in which, when mounted on at least one support member, it may move longitudinally relative to at least one support member but not be displaced laterally from at least one support member, and wherein at least one support member is tubular and the fitting defines a generally cylindrical passage through which the tubular support member extends.

2. A clothes airer as claimed in claim 1 wherein the fitting defines a through aperture, through which at least one support member extends.

3. A clothes airer as claimed in claim 1 wherein the fitting comprises two engageable components.

4. A clothes airer as claimed in claim 1 wherein at least one support member is elongate.

5. A clothes airer as claimed in claim 1 wherein there are four or more support members.

6. A clothes airer as claimed in claim 1 wherein at least one support member comprises a plurality of support members wherein each respective support member of the plurality of support members forms a leg for supporting the pair of pivotally connected frames above a surface.

7. A clothes airer as claimed in claim 1 wherein each pivotally connected frame is generally rectangular and includes a plurality of cross-members for supporting articles on the airer.

8. A clothes airer as claimed in claim 1 wherein one of the pair of pivotally connected frames is connected to at least one support member at free ends of the frames.

9. A clothes airer as claimed in claim 1 wherein each pivotally connected frame is connected to two support members.

10. A clothes airer as claimed in claim 1 wherein there are three or more pairs of pivotally connected frames.

11. A clothes airer as claimed in claim 1 wherein at least one support member is fitted with a wheel.

12. A clothes airer as claimed in claim 1, wherein the fitting defines a through aperture and the shape of the cross section of the aperture corresponds to the shape of the cross section of at least one support member.

13. A clothes airer as claimed in claim 1, wherein the fitting encircles at least one support member in a sliding fit.

14. A clothes airer as claimed in claim 1, wherein the fitting comprises a formation that defines an aperture via which one of the frames of the pivotally connected frames is pivotally connected to the fitting.

15. A clothes airer as claimed in claim 14, wherein the axis of the aperture extends substantially at right angles to that of at least one support member to which the fitting is mounted.

16. A clothes airer as claimed in claim 14, wherein the aperture is radially to the side of the part of the fitting which extends around at least one support member.

17. A clothes airer as claimed in claim 1, wherein at least one support member is U-shaped.

* * * * *